US008045742B2

(12) United States Patent
Chen

(10) Patent No.: US 8,045,742 B2
(45) Date of Patent: Oct. 25, 2011

(54) AUDIO HEADPHONE PROVIDED WITH DEVICE TO PREVENT AUDIO FEEDBACK

(76) Inventor: Jinsuan Chen, Chung Ho (TW)

( * ) Notice: Subject to any disclaimer, the term of this patent is extended or adjusted under 35 U.S.C. 154(b) by 749 days.

(21) Appl. No.: 12/219,015

(22) Filed: Jul. 15, 2008

(65) Prior Publication Data

US 2010/0014684 A1 Jan. 21, 2010

(51) Int. Cl.
*H04R 25/00* (2006.01)

(52) U.S. Cl. ..... 381/370

(58) Field of Classification Search ..... 381/71.1, 381/71.6, 370–375
See application file for complete search history.

(56) References Cited

U.S. PATENT DOCUMENTS

| | | | | |
|---|---|---|---|---|
| 5,182,774 | A * | 1/1993 | Bourk | 381/71.6 |
| 6,829,365 | B1 * | 12/2004 | Kim | 381/370 |
| 2007/0154049 | A1 * | 7/2007 | Levitsky et al. | 381/371 |
| 2010/0105447 | A1 * | 4/2010 | Sibbald et al. | 455/570 |

* cited by examiner

*Primary Examiner* — Tuyen Nguyen
(74) *Attorney, Agent, or Firm* — Welsh Flaxman & Gitler LLC

(57) ABSTRACT

An ear muff used with a headset containing two ear muffs. Both of the ear muffs are provided with a loudspeaker and a microphone for sensing ambient noise. An active noise reduction (ANR) circuitry is utilized to cancel the ambient noise. An immobile or inflexible disc is provided within each ear muff for preventing the change of dimensions of an enclosure which includes the loudspeaker and microphone, thereby preventing audio feedback.

17 Claims, 2 Drawing Sheets

AUDIO HEADPHONE PROVIDED WITH DEVICE TO PREVENT AUDIO FEEDBACK

FIELD OF THE INVENTION

The present invention is directed to audio headphones provided with noise cancellation circuitry.

BACKGROUND OF THE INVENTION

The use of headphones by individuals for the purpose of listening to audio programs including music or for simply filtering the ambient noise in our environment has become ubiquitous. This is true to the development of the MP3 player as well as the utilization of such services as ITunes to download music. Individual's are traversing the streets with their headphones in place as well as using them while they are utilizing public transportation such as airplanes, commuter and long distance railroads, as well as buses. While the use of these headphones does give the individual enjoyment, there are problems involved with the utilization of these devices. For example, ambient noise such as is produced by other passengers using the various modes of public transportation while talking on cell phones or with other passengers, would make the use of these devices less enjoyable. This is due to the fact that the individual would hear a constant verbal barrage generated by these other passengers or the sounds of the various conveyances themselves, such as the humming of airplane or bus engines.

These problems have been alleviated somewhat through the utilization of an active noise reduction (ANR) system used in conjunction with the headphones. These headphones are not only provided with a loudspeaker for producing music or any other audio output, they are also provided with a microphone for sensing the ambient noise in the environment. The ANR includes circuitry for sensing this ambient noise through the microphone and producing a signal which has the same amplitude as the ambient noise but is 180° out of phase of that signal. A negative feedback loop is provided introducing both the ambient noise to the loop, as well as the sound wave produced by the ANR which is 180° out of phase with the ambient noise, thereby cancelling and eliminating the ambient noise, and consequently allowing an individual to enjoy only the audio output produced by the loudspeaker.

However, due to the very limited space in which both the microphone as well as the loudspeaker are housed, a problem relating to audio feedback has occurred. Audio feedback is produced when the sound from the loudspeaker is fed into the microphone, creating a high pitched electronic squeal which typically rises in volume until various adjustments are made. When the audio feedback is created with both the loudspeaker and the microphone situated in a relatively large enclosure, such as an auditorium, corrective action such as turning down the volume of the loudspeaker or the microphone would alleviate the problem. However, when the enclosed space in which the loudspeaker and the microphone are included, such as is provided in a standard headphone is very limited in size, it is more difficult to correct this problem. Due to this relatively small enclosure, the operating parameters of both the loudspeaker and the microphone are tuned to a very low tolerance of error. Consequently, if the enclosed space in which both the loudspeaker and the microphone are housed is reduced even slightly due to even inadvertent pressure applied to the ear muff of the headphone, the annoying high pitch squeal due to the audio feedback would be produced.

SUMMARY OF THE INVENTION

The present invention overcomes the deficiencies of the prior art by utilizing a device included in at least one ear cup or ear piece but preferably both ear cups or ear pieces of the headset to prevent the changing of the dimension including the volume of the enclosure, as well as the perpendicular distance between the front and back of the enclosure housing both the loudspeaker and the microphone in an ANR system. This device would encompass an inflexible disc constructed from any solid material such as, but not limited to, plastic, metal or wood which is physically provided within the earpiece in a position adjacent to one end of the enclosure. Therefore, when pressure is applied to the exterior surface of the earpiece, the physical size of the enclosure including therein the loudspeaker and the microphone would not change and be reduced due to the inclusion of the inflexible disc. Generally, this inflexible disc, while covering all or a portion of the microphone, would be of such a size as to allow the ambient sound to travel from the exterior portion of the microphone to the enclosure including the loudspeaker and the microphone for the purpose of producing the noise cancellation signal.

Other objects, features and advantages according to the present invention will become apparent from the following detailed description of the illustrated embodiments when read in conjunction with the accompanying drawings in which corresponding components are identified by the same reference numerals.

DETAILED DESCRIPTION OF THE PRESENT INVENTION

Figure 1:
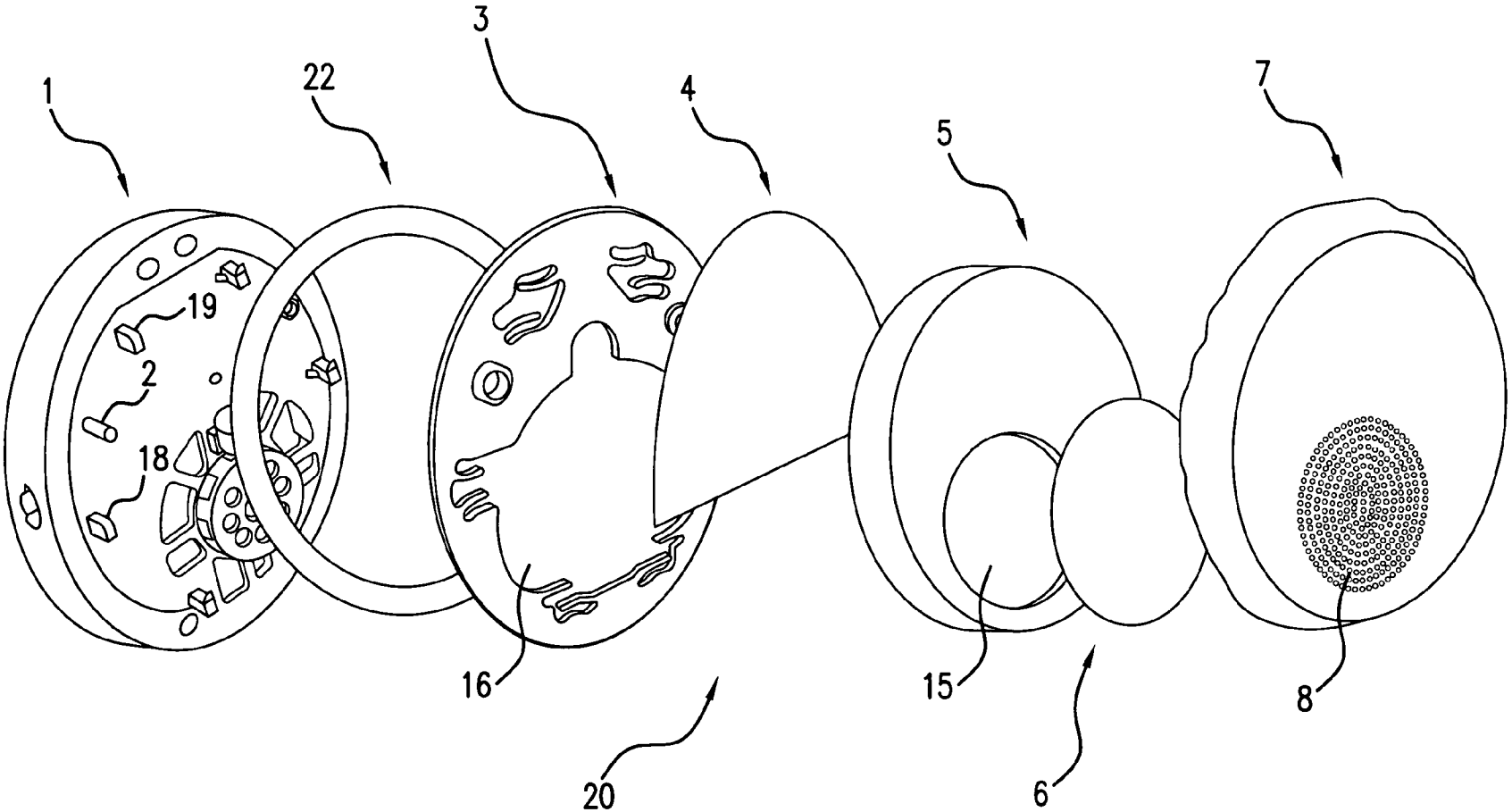
FIG. 1 is an exploded view of one earpiece of the headphone according to the present invention.
Figure 2:
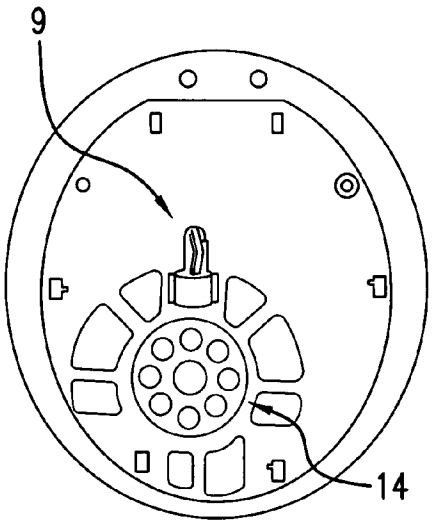
FIG. 2 is a view showing the microphone and loudspeaker of the present invention.

As illustrated in FIG. 1, a single ear cup 20 of the present invention includes a speaker housing 1, a foam sticker 2, an ear muff tray housing structure 3, an inflexible disc 4, a foam cushion 5 as well as an ear muff skin 7. As shown in FIGS. 1 and 2, the speaker housing would include a microphone 9, a speaker driver or loudspeaker 14 as well as a state-of-the-art ANR circuit 17 connected to both the microphone 9 and a loudspeaker 14. As can be appreciated and will be further explained, the ear cup 20 of the present invention is designed to be utilized with one side of a headphone connected to a similar ear cup using a state-of-the-art headband for connecting the two pieces of the ear cup together, each of which would cover one of the user's ears. Although not shown in the drawings, this similar ear cup would be identical to the structure of the ear cup 20 which would also include the ANR circuit, disc 4, the microphone 9 and the loudspeaker 14. A typical ANR circuit as well as the operation of this circuit is described in U.S. Pat. No. 7,251,335 issued to Chen and is incorporated herein by reference. The speaker housing 1 would include at least one dowel, peg, or similar spacer device as illustrated with respect to reference numerals 18, 19 and 22. The purpose of these support devices would be to act as a support for an enclosure whose dimensions would not change even when pressure is applied to the exterior of the ear cup 20. This enclosure is created utilizing the ear muff tray 3 cooperating with the support members 18, 19 and 22 and a foam sticker 2 to produce the enclosure. The ear muff tray 3 itself can be constructed from a relatively flexible material, but can also be relatively rigid and does include an opening 16 therethrough. The ear muff tray 3 is generally constructed from polycarbonite (PC). The speaker housing 1 and the ear muff tray 3 constitute two ends of the enclosure. The distance between the speaker housing 1 and the ear muff tray 3, must be at least 2 mm to prevent audio feedback. This distance is also equal to the thickness of the foam sticker 2 which is generally 2 mm.

The foam sticker 2 is provided between the speaker housing 1 and the ear muff tray 3. The foam sticker 2 is a ring-like member and is provided with adhesives on both surfaces of the ring-like member. A first surface of the ring-like member of the foam sticker 2 would adhere to a ring-like periphery portion 21 of the speaker housing 1. The second surface of the ring-like foam sticker 2 would adhere to the periphery of the ear muff tray 3.

The inflexible disc 4 which can be constructed from any inflexible material such as plastic or metal is provided between the ear muff tray 3 and a foam cushion 5. The purpose of the disc 4 is to insure that the dimensions including the volume of the enclosure in which the microphone 9 and the loudspeaker or speaker driver 14 are located, as well as the distance between the front and back of the enclosure do not change even if pressure is applied onto the foam cushion 5. The disc 4 is either physically attached to either or both of the ear muff tray 3 and the foam cushion 5 or is merely configured to be provided between the ear muff tray 3 and the foam cushion 5 without any fixation to either of these components. A standard ear muff skin 7 is applied to the exterior of the foam cushion 5. Alternatively, the ear muff tray 3 and the disc 4 can be combined into a single element.

Since it is important that ambient noise be introduced to the interior of the ear muff 20 and specifically to the microphone 9, provision must be made to accomplish this purpose. Consequently, the ear muff skin 7 is provided with a plurality of ventilation holes 9. Since the foam cushion 5 is generally constructed from a sound deadening material, a portion of this material is either removed from the foam cushion or was not constructed with foam material provided in an opening 15. Therefore, a material such as a non-woven cloth 6 is provided in or on the opening 15 allowing sound waves to pass from the ventilation holes 9, through the opening 15 and into the speaker housing 1 through an opening 16 provided in the ear muff tray as well as through the ring-like foam sticker 2. It is noted that it is possible that the non-woven cloth 6 not be included in the foam cushion 5 and the sound waves would merely pass through ventilation holes 9 and through the opening 15 as the sound wave travels to the speaker housing 1.

The disc 4 as shown in FIG. 1 has a hemispherical shape. It is noted that this shape is not required and what is important is that the disc not impede the sound wave from traveling through the ventilation holes 9, and into the speaker housing 1.

Figure 4:
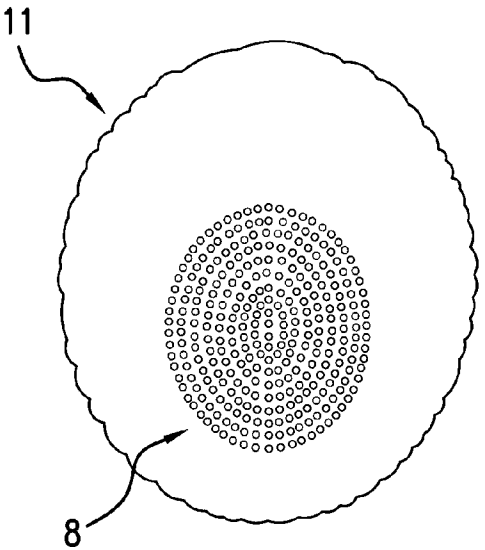
FIG. 4 is a view of the ear muff skin used in the present invention.
Figure 3:
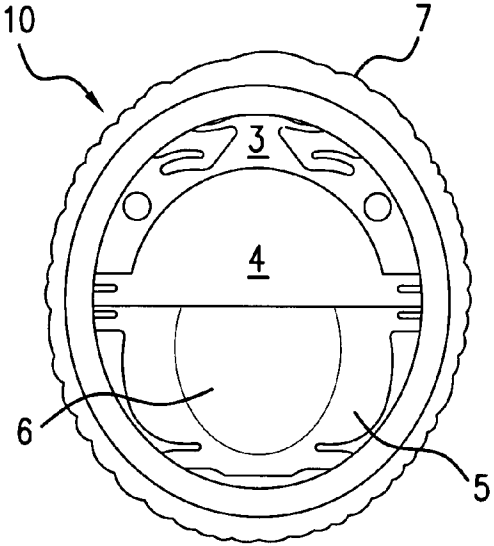
FIG. 3 is a bottom view of the assembled ear muff of the present invention.

FIG. 3 is a bottom view of a partially assembled ear muff 20 which includes the ear muff tray 3, the disc 4, the foam cushion 5, the woven cloth 6 and the ear muff skin 7. A front view of the ear muff 11 is illustrated with respect to FIG. 4 which does also show the ventilation holes 9.

Figure 5:
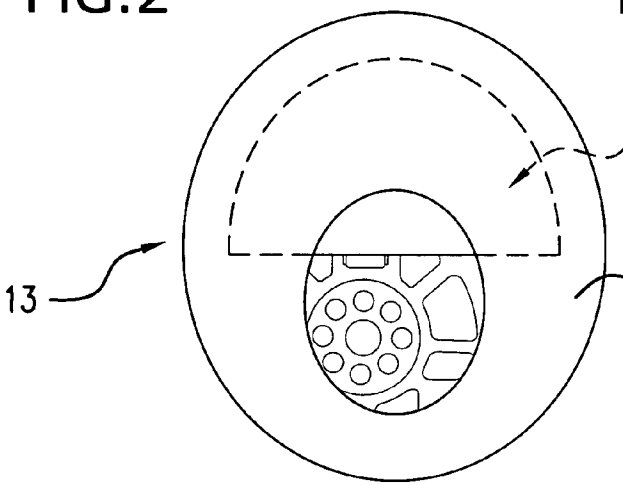
FIG. 5 is a front view of the assembled ear muff according to the present invention.

FIG. 5 shows a partially assembled ear muff 13 from the view of the speaker housing 1. In this view, the disc 4 is shown under the foam cushion 5. The foam cushion is secured to the ear muff 20 in a manner to enclose the ear muff including the speaker housing 1, the foam sticker 2, the earmuff tray 3 and the disc 4.

The foregoing description of specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalence of the disclosed embodiments. It is to be understood that the phraseology or terminology employed herein is for the purpose of description and not of limitation. Therefore, while the invention has been described in the terms of preferred embodiments, those skilled in the art will recognize that the invention can be practiced with modification within the spirit and scope of the appended claims.

What is claimed is:

1. A headphone including an ear muff provided with an active noise reduction circuit, the ear muff, comprising:

a support structure having a microphone and loudspeaker attached thereto;

a housing structure having a first side and a second side, said first side facing said support structure at a finite distance from said support structure to produce an enclosure between said support structure and said housing structure, said loudspeaker and said microphone provided within said enclosure;

an inflexible disc facing said second side of said housing; and a cushion enclosing said support structure, said housing structure and said flexible disc;

wherein when pressure is applied to said cushion, the distance between said support structure and said housing structure does not change due to the inclusion of said inflexible disc, thereby preventing audio feedback.

2. The headphone in conjunction with claim 1, further including at least one spacer provided between said support structure and said housing structure used to separate said support structure from said housing structure.

3. The headphone in conjunction with claim 1, wherein said at least one spacer is attached to said support structure.

4. The headphone in accordance with claim 1, further including an ear muff skin covering said cushion.

5. The headphone in accordance with claim 4, wherein said ear muff skin provided with a plurality of holes allowing ambient noise to enter the ear muff.

6. The headphone in accordance with claim 5, wherein said cushion is provided with a first opening aligned with said plurality of holes.

7. The headphone in accordance with claim 6, wherein said housing structure is provided with a second opening aligned with said first opening and said plurality of holes allowing ambient noise to travel through the ear muff and enter said enclosure.

8. The headphone in accordance with claim 1, wherein an adhesive member is provided between said support structure and said housing structure.

9. The headphone in accordance with claim 1, wherein said first opening is covered by a non-woven cloth.

10. The headphone in accordance with claim 1, wherein said inflexible disc is constructed from a plastic material.

11. The headphone in accordance with claim 1, wherein said inflexible disc is constructed from a metallic material.

12. The headphone in accordance with claim 1, wherein said inflexible disc is constructed from a wooden material.

13. The headphone in accordance with claim 1, wherein said disc has a hemispherical shape.

14. The headphone in accordance with claim 10, wherein said disc has a hemispherical shape.

15. The headphone in accordance with claim 11, wherein said disc has a hemispherical shape.

16. The headphone in accordance with claim 12, wherein said disc has a hemispherical shape.

17. The headphone in accordance with claim 1, wherein the distance between said support structure and said housing structure is at least 2 mm.

* * * * *